US005575330A

United States Patent [19]

Hoeffken

[11] Patent Number: 5,575,330

[45] Date of Patent: Nov. 19, 1996

[54] FURNACE HEAT EXCHANGER SEAL AND METHOD OF MAKING SAME

[75] Inventor: Russell W. Hoeffken, Belleville, Ill.

[73] Assignee: Alco Industries, Inc., Valley Forge, Pa.

[21] Appl. No.: 491,685

[22] Filed: Jun. 19, 1995

Related U.S. Application Data

[63] Continuation of Ser. No. 303,132, Sep. 8, 1994, abandoned, which is a continuation of Ser. No. 7,507, Jan. 22, 1993, abandoned.

[51] Int. Cl.[6] ..... F28F 9/04

[52] U.S. Cl. ..... 165/170; 165/178; 29/890.038; 29/890.043; 126/110 R; 126/116 R; 126/119

[58] Field of Search ..... 165/170, 173, 165/178; 126/99 A, 99 C, 99 R, 109, 110 R, 116 R, 119; 29/890.38, 890.43

[56] References Cited

U.S. PATENT DOCUMENTS

| | | | |
|---|---|---|---|
| 3,696,862 | 10/1972 | Dijk | 165/178 |
| 3,908,629 | 9/1975 | Wiese | 165/178 X |
| 3,940,837 | 3/1976 | Wiese | 126/119 X |
| 4,538,338 | 9/1985 | Hoeffken et al. | 126/119 X |
| 4,547,943 | 10/1985 | Hoeffken | 126/119 X |
| 4,649,894 | 3/1987 | Hoeffken | 165/178 X |
| 4,663,837 | 5/1987 | Hoeffken et al. | 29/797 |
| 4,893,390 | 1/1990 | Hoeffken | 29/890.03 |
| 4,982,785 | 1/1991 | Tomlinson | 165/170 |
| 5,042,453 | 8/1991 | Shellenberger | 126/116 R X |

*Primary Examiner*—John Rivell
*Attorney, Agent, or Firm*—Gomer W. Walters

[57] ABSTRACT

A heat exchanger assembly comprises a partition or mounting plate with an aperture therethrough and a heat exchanger wall with an opening therethrough where the plate and wall are assembled together with the plate aperture and wall opening adjoined and sealed by a sponge pad in accordance with the method of the invention.

19 Claims, 2 Drawing Sheets

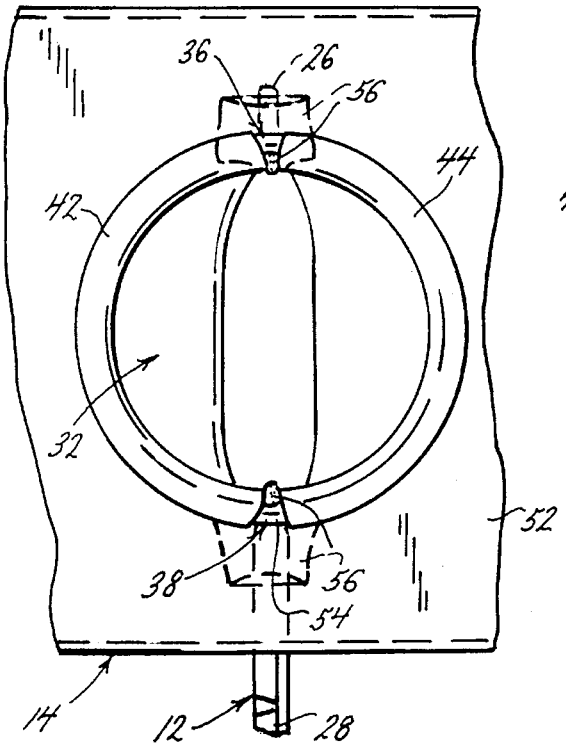
FIG. 4.
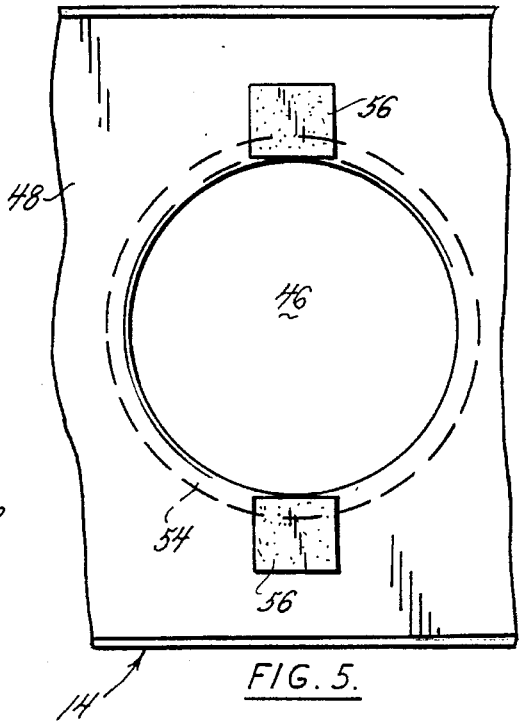
FIG. 5.
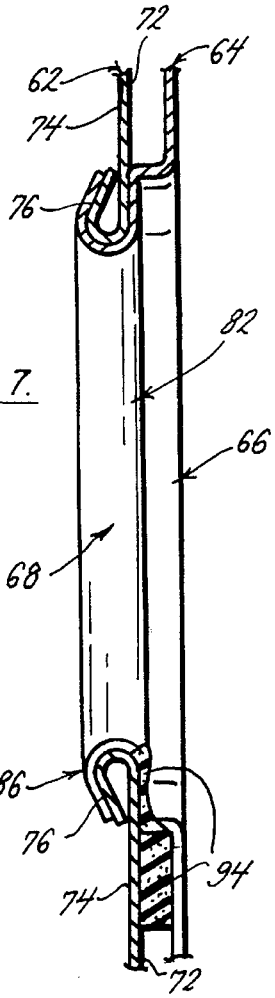
FIG. 7.
FIG. 6.
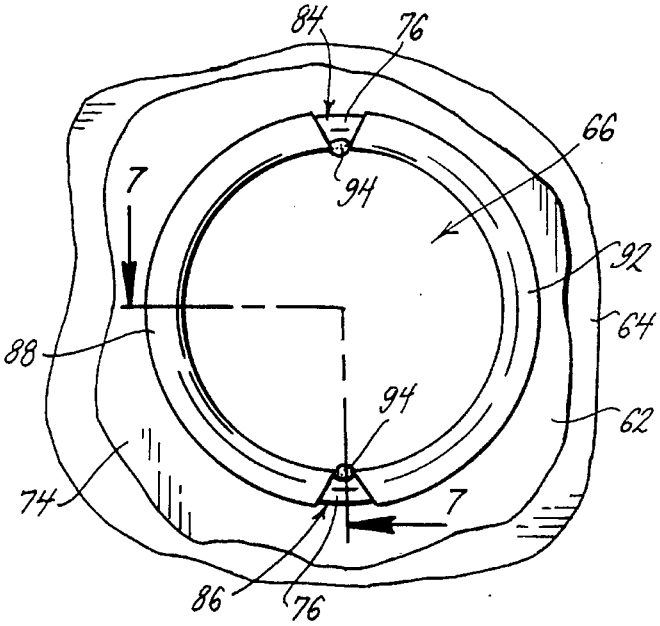

FURNACE HEAT EXCHANGER SEAL AND METHOD OF MAKING SAME

This application is a continuation of application Ser. No. 08/303,132, filed Sep. 8, 1994, now abandoned, which is a continuation of application Ser. No. 08/007,507, filed Jan. 22, 1993, now abandoned.

BACKGROUND OF THE INVENTION (1) Field of the Invention

The present invention pertains to a furnace heat exchanger seal that employs a silicone sponge pad and the method of employing the pad in sealing connections between furnace heat exchanger component parts.

(2) Description of the Related Art

In the construction of furnace heat exchangers, the heat exchanger cell or combustion chamber is typically connected to a mounting plate. The connection is made with an aperture in the plate adjoining the burner and flue gas opening in the heat exchanger cell. To prevent flue gases from mixing with the heated air circulated over the heat exchanger cell exterior, the connection of the mounting plate aperture and heat exchanger cell opening must be sealed air tight. The present practice of sealing heat exchanger seams involves applying a bead of a wet sealant around the plate aperture prior to insertion of a flange surrounding the heat exchanger opening through the aperture and bending the flange outward around the aperture in connecting the heat exchanger to the mounting plate.

In some applications, the wet sealant paste or gum is applied at points adjacent the mounting plate aperture that correspond to positions of seams in the heat exchanger when the heat exchanger is joined to the mounting plate. The wet sealant applied at these points on the mounting plate seals any openings between the heat exchanger seams and the mounting plate once the heat exchanger is assembled to the mounting plate.

Each of the above described prior art methods of sealing the connections between furnace mounting plates and heat exchanger cells are disadvantaged in that the sealant must be applied just prior to the connection of a heat exchanger cell to a mounting plate. Sealants, such as wet silicone, set-up after a short period of time so the heat exchanger cell and mounting plate must be assembled together shortly after application of the wet sealant. This prevents furnace component parts from being stockpiled with the sealant already applied to the parts because the sealant will set-up before the parts are used in assembling a furnace. The requirement that the sealant be applied to the parts just prior to their assembly adds an additional step in the assembly of furnace heat exchangers to mounting plates. The additional assembly step results in an increase in the costs involved in manufacturing furnace heat exchanger assemblies.

In efforts to reduce the costs involved in constructing furnace heat exchanger assemblies, the sealant application process has been automated. However, because the typical wet sealant will set up after a short period of time, the automated application of sealant to the parts of a heat exchanger assembly must still take place just prior to the assembly of the parts. Moreover, the automated process of applying sealant at times applies more sealant than is necessary for the seal, thereby wasting sealant and increasing production costs. Too much sealant applied to the connection of a furnace heat exchanger wall and a mounting plate, whether manually or by automation, will also often cause sealant to stick to the flange bending tools employed in forming the connection. This results in the added expense of the down time of the tool while it is cleaned or repaired.

SUMMARY OF THE INVENTION

The apparatus and method of the present invention overcome the above set forth disadvantages associated with prior art methods of sealing heat exchanger assemblies by providing a silicone sponge pad as a seal between connected mounting plates and heat exchanger walls of furnace heat exchanger assemblies. The present invention provides a heat exchanger assembly comprising a partition or mounting plate with an aperture therethrough and a heat exchanger wall with an opening therethrough where the plate and wall are assembled together with the plate aperture and wall opening adjoined and sealed by the sponge pad of the present invention.

According to the method of the invention, a silicone sponge pad is secured to the mounting plate adjacent the plate aperture in a position corresponding to a seam end or a notch through a flange of the heat exchanger wall that connects the wall to the mounting plate. With the pad connected to the mounting plate adjacent the aperture, the heat exchanger wall is positioned adjacent the mounting plate with a flange surrounding the wall opening extending through the mounting plate aperture. Either a seam end of the heat exchanger wall or a notch cut through the flange to facilitate its bending is pressed against the sponge pad secured to the mounting plate. As the heat exchanger flange is then bent radially outward around the perimeter of the mounting plate aperture to secure the heat exchanger wall to the mounting plate, the sponge pad is pressed between the heat exchanger seam or flange notch and the mounting plate and seals the seam or notch at the connection of the heat exchanger wall to the mounting plate. In variant applications of the silicone sponge sealing pad, the pad may be adhered to the side of the mounting plate to which the heat exchanger wall is attached, or the opposite side of the mounting plate over which the heat exchanger flange is bent.

The silicone sponge pad is provided with a self-adhesive layer on one side that is covered over with an easily removed protective cover. The cover is first peeled off of the adhesive layer and the sponge pad is pressed in its desired position on the mounting plate with the adhesive of the pad holding it in position. Unlike prior art wet sealants, the sponge pad may be applied to component parts of a furnace heat exchanger that are stockpiled for a period of time prior to assembling the component parts into a furnace heat exchanger assembly. In this manner, use of the sealing silicone sponge pad of the invention in providing a seal between heat exchanger assembly component parts overcomes the disadvantages associated with the prior art practice of employing a wet sealant in sealing heat exchanger parts.

BRIEF DESCRIPTION OF THE DRAWINGS

Further objects and features of the present invention are revealed in the following detailed description of the preferred embodiment of the invention and in the drawing figures wherein:

FIG. 4 is a partial front elevation view of the sealed connection of the invention;

FIG. 5 is a partial rear elevation view taken along the line 5—5 of FIG. 3;

FIG. 6 is a partial front elevation view of a second embodiment of the sealed connection of the invention; and FIG. 7 is a partial view taken along the line 7—7 of FIG. 6.

DETAILED DESCRIPTION OF THE PREFERRED EMBODIMENTS

Figure 1:
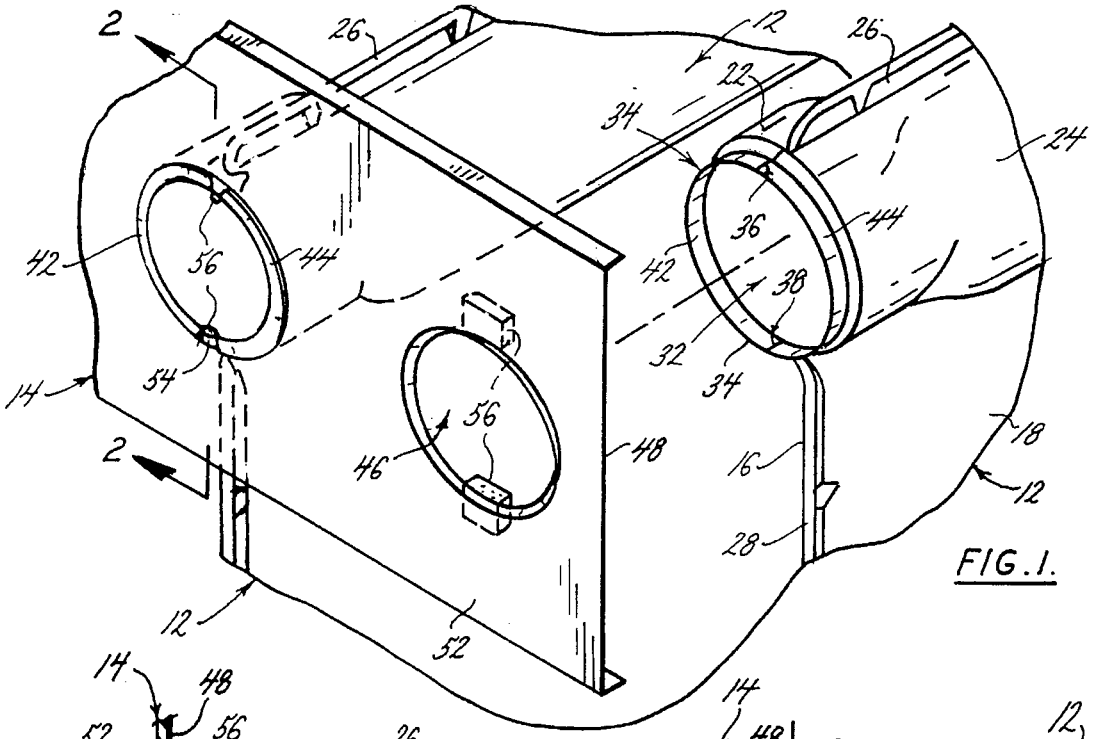
FIG. 1 is a partial perspective view showing the sealed connection between a furnace mounting plate and a heat exchanger unit of the present invention, and illustrating the method of forming the sealed connection.
Figure 2:
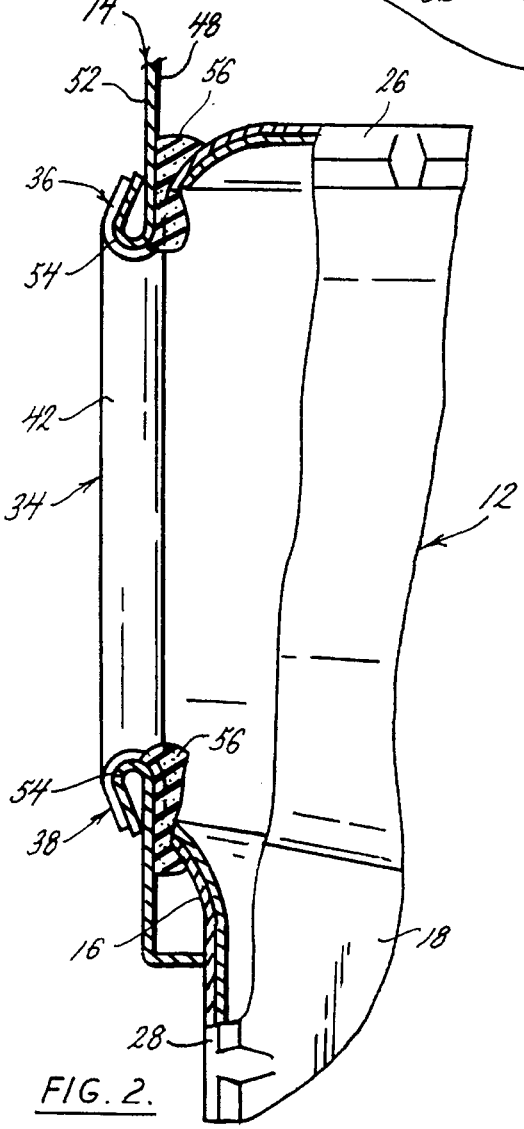
FIG. 2 is a partial side elevation view taken along the line 2—2 of FIG. 1.
Figure 3:
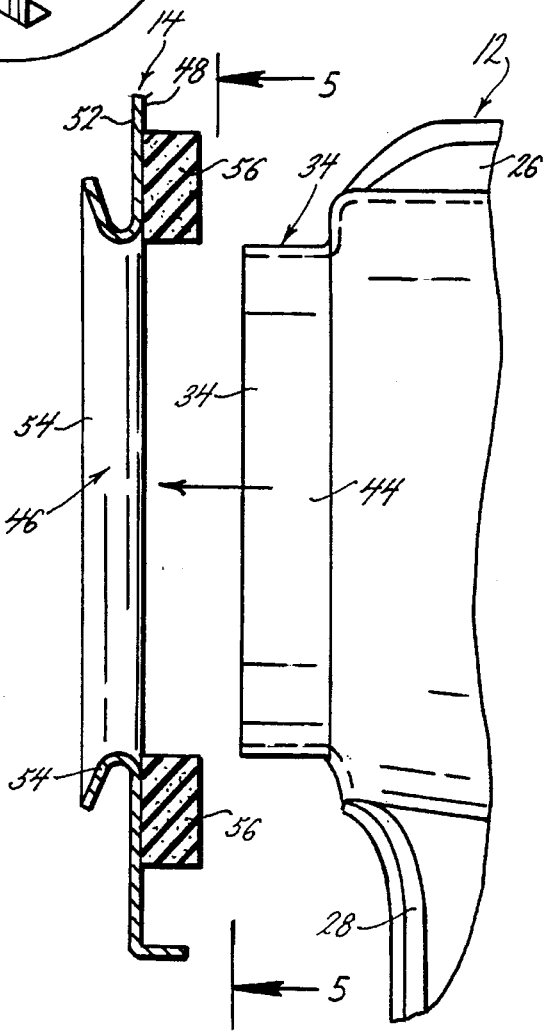
FIG. 3 is a partial side elevation view illustrating the method of making the sealed connection of the invention.

FIG. 1 is a partial view of a conventional furnace heat exchanger assembly comprising a heat exchanger cell 12 connected to a mounting plate 14 and illustrating the sealed connection of the invention. The construction of a conventional heat exchanger cell 12 and mounting plate 14 assembled together in forming heat exchanger assemblies for furnaces is well known in the art and will not be described in detail. The two heat exchanger cells 12 shown in FIG. 1 are substantially identical and like reference numbers will be employed to identify like component parts of the two cells.

The heat exchanger cell 12 is constructed from two cell wall sections 16, 18 each having one half of the configuration of a gas conducting conduit 22, 24 formed therein. The wall sections are joined together along adjacent edges by folded seams 26, 28 formed in the adjacent edges. The cell wall sections 16, 18 are typically joined together along the seams 26, 28 completely enclosing an interior volume of the heat exchanger cell 12 except for two access openings, one of the openings 32 being shown in FIG. 1. As seen in FIG. 1, the seams 26, 28 extend over the cell wall segments and terminate at seam ends just short of a flange 34 surrounding the cell opening 32. The termination of the seams short of the flange 34 leaves unconnected portions of the wall section edges crossing the flange 34. These unconnected adjacent edges of the wall sections form notches 36, 38 extending through the flange 34 and dividing the flange into two separate flange segments 42, 44. It should be understood that in other constructions of furnace heat exchanger cells, additional folded seams of the cell wall sections may terminate at the opening flange forming additional notches through the flange than the two shown in FIG. 1. The heat exchanger cell assembly sealing connection of the present invention is equally well suited for sealing the connections between mounting plates and heat exchanger cells having any number of seams terminating at the opening of the heat exchanger cell.

The furnace mounting plate 14 is also conventional and is shown comprising a thin, flat plate having outturned top and bottom edges for structural rigidity and having a pair of apertures 46 extending through the plate 14 from a plate interior surface 48 to a plate exterior surface 52. It should be understood that calling the opposite surfaces of the mounting plate 14 an interior surface and exterior surface are for reference purposes only and should not be interpreted as limiting. In forming the apertures 46 through the mounting plate 14 portions of the plate material surrounding the apertures are flared outward from the plate exterior surface 52 forming rims 54 surrounding the apertures.

The sealed connection between the furnace heat exchanger cell 12 and the mounting plate 14 of the invention involves employing silicone sponge pads 56 in lieu of the wet sealant employed in the prior art. A silicone sponge pad is preferred for its heat resistant properties. However, sponge pads of other types of heat resistant materials may be employed in the invention and the described use of a silicone sponge pad should not be interpreted as limiting.

According to the method of the invention in constructing the sealed connection of the invention, the sponge pad is provided with a self adhesive layer on one side covered by a protective strip (not shown). In constructing the sealed connection, the protective cover strip of the adhesive is removed from the sponge pad and the pad is adhered to one surface of the mounting plate 14 adjacent the plate aperture 46. In FIG. 1, the sponge pads 56 are shown adhered to the interior surface 48 of the mounting plate. In other applications of the invention the sponge pads may be adhered to the exterior surface 52 of the mounting plate or the surface opposite the connected heat exchanger cell 12 as will be explained. The number of sponge pads 56 adhered to the mounting plate interior surface 48 correspond to the number of flange notches of the heat exchanger cell to be connected to the mounting plate. In the example shown in FIG. 1, sponge pads 56 are adhered to the mounting plate surface 48 for the two flange notches 36, 38 of the heat exchanger cell. Also as shown in FIG. 1, each of the sponge pads 56 is positioned adjacent the plate aperture 46 in a position that corresponds to the position of the heat exchanger cell notch 36, 38 when the heat exchanger is attached to the plate.

With the sponge pads 56 adhered to the mounting plate surface 48 in the positions shown in the drawing figures, the heat exchanger flange 34 is then inserted through the plate aperture 46. As the cell flange 34 is inserted through the aperture 46, the sponge pads 56 are pressed between the plate surface 48 and the flange notches 36, 38 thereby providing a seal between the plate surface 48 and the flange notches 36, 38 at the end of the cell seams 26, 28, respectively.

To connect the cell 12 to the plate 14, the flange segments 42, 44 are bent and folded radially outward from the plate aperture 46 over the plate exterior surface 52 and the plate rim 54. As the flange segments 42, 44 are folded radially outward the notches 36, 38 separating the segments spread apart. Folding the flange segments 42, 44 over the plate rim 54 pulls the heat exchanger cell 12 tight against the plate surface 48 further compressing the sponge pads 56 between the plate surface and the cell and forcing a portion of the sponge pads into the open flange notches 36, 38. In this manner and according to the above described method, the sponge pads 56 provide the sealed connection of the invention between the mounting plate 14 and the heat exchanger cell 12 with the plate aperture 46 adjoining the cell opening 32.

In variant applications of the above described sealed connection and method of the invention, the flange surrounding the heat exchanger opening and the notches formed through the flange may be entirely inserted through the aperture opening of the mounting plate. In these applications it may be desirable to position the sealing sponge pads between the connection of the heat exchanger cell and the mounting plate on the exterior surface 52 of the mounting plate. To form the sealed connection, the sponge pads are merely secured to the exterior surface 52 of the mounting plate adjacent the plate aperture and in positions corresponding to the positions of the flange notches when the heat exchanger cell is connected to the plate. In connecting the cell to the plate by folding the cell flanges radially outward from the plate aperture and over the exterior of the plate, the cell flanges press the sponge pads between the flanges and the plate exterior surface and into the notches formed between flange segments, thereby forming a sealed connection between the heat exchanger cell and the mounting plate with the plate aperture and cell opening adjoined.

FIGS. 6 and 7 show a variation of the sealed connection and the method of the invention employed in providing a sealed connection between a parallel plate 62 and a wall 64 of a furnace heat exchanger assembly where seams connecting sections of the wall 64 do not terminate at the wall opening 66. The method employed and the sealed connection formed in this embodiment of the invention is very similar to that of the previously described embodiment. The construction of the mounting plate 62 is the same as the previously described plate including an aperture 68 extending through the plate from an interior surface 72 to an exterior surface 74, and a flared rim 76 surrounding the aperture and extending outward from the plate exterior surface. The wall opening 66 is again surrounded by a flange 82. However, with no wall seams intersecting the opening the wall flange 82 is provided with a pair of notches 84, 86 extending through the flange to facilitate its being bent around the plate aperture periphery. As in the first described embodiment, the notches 84, 86 divide the flange 82 into two flange segments 88, 92.

Forming the sealed connection of the invention in accordance with the method of the invention is substantially the same as that described with reference to the first embodiment. The pair of sponge pads 94 are first secured to the interior surface 72 of the mounting plate adjacent the plate aperture 68 and in positions corresponding to the positions of the heat exchanger flange notches 84, 86 when the heat exchanger wall is connected with the mounting plate. The wall 64 is then positioned against the interior surface 72 of the mounting plate pressing the sponge pads 94 between the notches 84, 86 and the mounting plate and thereby sealing the flange notches. The wall flange segments 88, 92 are inserted through the plate aperture 68 and are folded radially outward from the aperture over the aperture rim 76. As the flange segments are folded outward over the aperture rim they pull the wall 64 toward the plate 62 pressing the sponge pads between the wall and plate and into the wall notches 84, 86. In this manner, the sealed connection of the invention constructed in accordance with the method of the invention provides a sealed connection between the mounting plate 62 and heat exchanger wall 64 with the plate aperture and wall opening adjoined without the need for wet sealants.

As described with reference to the first embodiment, in variant applications of the invention it may be necessary to adhere the sponge pads to the exterior plate surface 74 adjacent the plate aperture 68. By inserting the wall flange segments 88, 92 through the plate aperture 68 and then folding the flange segments radially outward over the aperture rim 76, the sponge pads 94 are pressed between the flange segments 88, 92 and into the notches 84, 86, thereby forming a sealed connection between the mounting plate and heat exchanger wall with the plate aperture and wall opening adjoined.

In a further variation of both of the previously described two embodiments, it should be understood that the sealed connection and the method of the invention employed in providing the sealed connection between a mounting plate and a heat exchanger cell may be formed by bending the rim of the mounting plate aperture into and radially outward over the flange of the heat exchanger cell inside the cell interior volume. Prior art heat exchanger cell and mounting plate connections of this type are disclosed in U.S. Pat. Nos. 4,649,894; 4,663,837 and 4,893,390, all of which are incorporated herein by reference. The relative positions of the component parts of the furnace mounting plate and heat exchanger cell are substantially identical to those shown in FIG. 1. The only difference in this embodiment of the connection is that the position of the mounting plate rim 54 is reversed so that it extends outward from the interior surface 48 of the mounting plate. The sponge pad 56 is positioned in the same position relative to the mounting plate aperture 46 and just outside the periphery of the mounting plate rim 54. The sealed connection of this variant embodiment of the invention is constructed in substantially the same manner as the first embodiment of the invention described above with reference to FIG. 1. However, in this variant embodiment, the mounting plate rim 54 is inserted into the periphery of the heat exchanger cell flange 34 into the cell opening 32. As the rim 54 is inserted through the opening 32, the sponge pads 56 are pressed between the plate surface 48 and the flange notches 36, 38 thereby providing a seal between the plate surface 48 and the flange notches 36, 38 at the end of the cell seams 26, 28, respectively.

In connecting the plate 14 to the cell 12, the plate rim 54 is bent and folded radially outward from the cell opening 32 over the cell interior surface and the cell flange segments 42, 44. Folding the plate rim 54 over the interior surfaces of the flange segments 42, 44 pulls the mounting plate 14 tight against the heat exchanger cell 12 further compressing the sponge pads 56 between the interior plate surface 48 and the cell seam ends and forcing a portion of the sponge pads into any openings of the flange notches 36, 38 adjacent the ends of the seams. In this manner and according to the above described method, the sponge pads 56 provide the sealed connection of the invention between the mounting plate 14 and the heat exchanger cell 12 with the plate aperture 46 adjoining the cell opening 32 and with the rim 54 extending into the cell interior and being folded radially outward over the interior surfaces of the cell flange segments 42, 44.

While the present invention has been described by reference to specific embodiments, it should be understood that modifications and variations of the invention may be constructed without departing from the scope of the invention defined in the following claims.

What is claimed is:

1. A heat exchanger assembly for a furnace, the heat exchanger assembly comprising:

a heat exchanger cell formed from at least one wall surrounding a hollow interior volume of the cell, the cell having an opening therein providing access to the interior volume of the cell, and the cell wall having a pair of adjacent edges joined together by a seam, the seam extending over the cell wall and terminating at an end of the seam at the opening in the cell;

a mounting plate having at least one aperture therethrough;

a heat resistant, deformable sponge pad secured to one side of the mounting plate adjacent the aperture, said sponge pad having a width greater than the width of the seam end but only a small fraction of the total circumference of said mounting plate aperture; and the heat exchanger cell being secured to the mounting plate with the cell opening adjoining the mounting plate aperture and with the seam end pressed against the sponge pad whereby the sponge pad is partially forced into the seam end to provide a seal between the seam end and the mounting plate but does not otherwise extend to the opposite side of said mounting plate.

2. The assembly of claim 1, wherein:

the seam is formed by at least one of the adjacent wall edges being folded over an other of the adjacent wall edges.

3. The assembly of claim 1, wherein:

the mounting plate has opposite first and second surfaces and the heat exchanger cell is secured to the first surface of the mounting plate;

and the sponge pad is secured to the first surface of the mounting plate and provides a seal between the seam end and the first surface of the mounting plate.

4. The assembly of claim 1, wherein:

the mounting plate has opposite first and second surfaces and the heat exchanger cell is secured to the first surface of the mounting plate with the seam end extending through the mounting plate aperture and over the second surface of the mounting plate;

and the sponge pad is secured to the second surface of the mounting plate and provides a seal between the seam end and the second surface of the mounting plate.

5. A heat exchanger assembly for a furnace, the heat exchanger assembly comprising:

a heat exchanger cell formed from at least one wall surrounding a hollow interior volume of the cell, the cell having an opening therein providing access to the interior volume of the cell, and the cell wall having a pair of adjacent edges joined together by a seam, the seam extending over the cell wall and terminating at an end of the seam at the opening in the cell;

a mounting plate having at least one aperture therethrough;

a heat resistant silicone sponge pad secured to the mounting plate adjacent the aperture; and the heat exchanger cell being secured to the mounting plate with the cell opening adjoining the mounting plate aperture and with the seam end pressed against the sponge pad whereby the sponge pad provides a seal between the seam end and the mounting plate.

6. A heat exchanger assembly for a furnace, the heat exchanger assembly comprising:

a heat exchanger cell formed from a pair of opposed walls enclosing a hollow interior volume of the cell therebetween, the cell having an opening therein providing access to the interior volume of the cell, and the pair of cell walls joined together at adjacent edges of the walls by a pair of seams that extend over the cell walls and terminate at a pair of seam ends at the opening in the cell;

a mounting plate having at least one aperture therethrough;

a pair of sponge pads secured to the mounting plate adjacent the aperture and spaced from each other; and the heat exchanger cell being secured to the mounting plate with the cell opening adjoining the mounting plate aperture and with each seam end of the pair of seam ends pressed against a sponge pad of the pair of sponge pads, whereby the pair of sponge pads provide seals between the seam ends and the mounting plate.

7. A heat exchanger assembly for a furnace, the heat exchanger assembly comprising:

a heat exchanger cell formed from a plurality of separate walls, the plurality of walls interconnected by a plurality of seams with the interconnected walls surrounding a hollow interior volume of the cell, the cell having an opening therein providing access to the interior volume of the cell, and a plurality of seams extending over the cell walls and terminating at a plurality of seam ends at the opening in the cell;

a mounting plate having at least one aperture therethrough;

a plurality of sponge pads secured to the mounting plate with each of the sponge pads being spaced from each other and each of the sponge pads being adjacent the aperture; and the heat exchanger cell being secured to the mounting plate with the cell opening adjoining the mounting plate aperture and with each seam end of the plurality of seam ends pressed against a sponge pad of the plurality of sponge pads, whereby the plurality of sponge pads provide seals between the seam ends and the mounting plate.

8. A heat exchanger assembly for a furnace, the heat exchanger assembly comprising:

a plate having opposite first and second surfaces and at least one aperture through the plate between its first and second surfaces;

a wall having opposite first and second surfaces and at least one opening through the wall between its first and second surfaces, the wall having a flange that projects outward from the second surface of the wall and extends around the wall opening, the flange having at least one notch through the flange;

a sponge pad secured to the plate adjacent the aperture; and, the wall being secured to the plate with the wall second surface and the plate first surface mutually opposed, the wall being secured to the plate by the flange extending through the plate aperture from the plate first surface to the plate second surface and the flange being folded over the plate second surface, and the flange notch being pressed against the sponge pad whereby the sponge pad provides a seal between the flange and the plate sealing the flange notch.

9. The assembly of claim 8, wherein:

the sponge pad is a heat resistant silicone sponge pad.

10. The assembly of claim 8, wherein:

the sponge pad is secured to the first surface of the plate and is pressed between the plate first surface and the wall second surface and into the flange notch, whereby the sponge pad seals the flange notch.

11. The assembly of claim 8, wherein:

the sponge pad is secured to the second surface of the plate and is pressed between the second surface of the plate and the second surface of the wall and into the flange notch, whereby the sponge pad seals the flange notch.

12. The assembly of claim 8, wherein:

the flange has a plurality of notches that each extend through the flange and divide the flange into a plurality of separate flange segments;

a plurality of sponge pads are secured to the plate spaced from each other and positioned adjacent the plate aperture; and, the wall is secured to the plate by the plurality of flange segments extending through the plate aperture from the plate first surface to the plate second surface and the flange segments being folded over the plate second surface, and the plurality of flange notches each being pressed against a sponge pad of the plurality of sponge pads whereby the sponge pads provide seals between the flange segments and the plate sealing the plurality of flange notches.

13. In a furnace heat exchanger assembly, a method of forming a sealed connection between a plate with an aperture therethrough and a wall with an opening therethrough whereby the plate aperture is adjoined with the wall opening, the method comprising:

forming a flange on the wall with the flange extending around and projecting outward from the wall opening;

providing a notch through the flange to facilitate folding the flange radially away from the wall opening;

securing a sponge pad to the plate in a position on the plate adjacent the plate aperture;

positioning the wall against one side of the plate while inserting the flange through the plate aperture to an other side of the plate with the flange notch positioned adjacent the sponge pad;

folding the wall flange radially outward away from the wall opening and over the other side of the plate and pressing the sponge pad between the flange and the plate and into the flange notch, thereby forming a sealed connection between the wall and the plate with the wall opening adjoining the plate aperture.

14. The method of claim 13, further comprising:

securing a heat resistant silicone sponge pad to the plate.

15. The method of claim 13, further comprising:

securing the sponge pad to the one side of the plate and pressing the sponge pad between the plate one side and the flange and into the flange notch while folding the flange radially outward from the wall opening and over the other side of the plate.

16. The method of claim 13, further comprising:

securing the sponge pad to the other side of the plate and pressing the sponge pad between the plate other side and the flange and into the flange notch while folding the flange radially outward from the wall opening and over the other side of the plate.

17. The method of claim 13, further comprising:

providing a plurality of notches in spaced positions through the flange to facilitate folding the flange radially away from the wall opening;

securing a plurality of separate sponge pads to the plate in spaced positions on the plate adjacent the plate aperture and corresponding to the spaced positions of the notches through the flange; and, positioning the wall against the one side of the plate while inserting the flange through the plate aperture to the other side of the plate with each flange notch positioned adjacent a sponge pad;

and then folding the wall flange radially outward away from the wall opening and over the other side of the plate and pressing each of the sponge pads between the flange and the plate and into one of the flange notches, thereby forming a sealed connection between the wall and the plate with the wall opening adjoining the plate aperture.

18. The method of claim 13, further comprising:

forming the wall from at least a pair of separate wall sections having adjacent edges by joining the edges together with a seam, extending the seam over the wall to the wall opening, terminating the seam short of the wall flange and forming the notch in the wall flange from portions of the adjacent edges of the wall segments not joined by the seam.

19. The method of claim 13, further comprising:

forming the wall from at least a pair of opposed wall sections enclosing a hollow interior volume therebetween, joining the wall sections together by aligning adjacent edges of the wall sections and forming the adjacent edges into folded seams that extend around the wall sections and terminate at opposite seam ends at opposite sides of the wall opening adjacent the wall flange, forming at least a pair of notches in the wall flange from portions of the adjacent edges of the wall segments not joined by the seams;

securing a plurality of separate sponge pads to the plate in spaced positions on the plate adjacent the aperture;

positioning the wall against the one side of the plate while inserting the flange through the plate aperture to the other side of the plate with each flange notch formed in the wall flange positioned adjacent a sponge pad;

and then folding the wall flange radially outward away from the wall opening and over the other side of the plate and pressing each of the sponge pads into one of the flange notches; thereby forming a sealed connection between the wall and the plate with the wall opening adjoining the plate aperture.

* * * * *